US005488386A

United States Patent [19]

Yamagishi et al.

[11] Patent Number: 5,488,386

[45] Date of Patent: Jan. 30, 1996

[54] IMAGING APPARATUS AND OPERATION METHOD OF THE SAME

[75] Inventors: Toshio Yamagishi, Kawasaki; Masakazu Nanba; Norifumi Egami, both of Tokyo; Kenkichi Tanioka, Tama; Mitsuhiro Kurashige, Yono; Kazutaka Tsuji, Hachioji; Yoshiyuki Kaneko, Hachioji; Tatsuo Makishima, Tokyo; Kazuyuki Nagatsuma, Hachioji; Tetsuya Ohshima, Kokubunji; Yasushi Nakano, Tokyo, all of Japan

[73] Assignees: Hitachi, Ltd. & Nippon Hoso Kyokai, both of Tokyo, Japan

[21] Appl. No.: 160,655

[22] Filed: Dec. 2, 1993

[30] Foreign Application Priority Data

Dec. 2, 1992 [JP] Japan ..... 4-322911

[51] Int. Cl.[6] ..... G09G 3/22

[52] U.S. Cl. ..... 345/74; 345/75

[58] Field of Search ..... 345/74, 75, 76, 345/84

[56] References Cited

U.S. PATENT DOCUMENTS 4,453,182 6/1984 Wilkinson et al. .

4,575,765 3/1986 Hirt ..... 345/74

FOREIGN PATENT DOCUMENTS 2637123 9/1988 France .
54154927 12/1979 Japan .
63110538 5/1988 Japan .
763190 12/1956 United Kingdom .

OTHER PUBLICATIONS

Kenkichi Tanioka et al., "An Avalanche-Mode Amorphous Selenium Photoconductive Layer for Use As a Camera Tube Target," IEEE Electron Device Letters, vol. EDL-8, No. 9, Sep., 1987, pp. 392-394.

*Primary Examiner*—Ulysses Weldon
*Assistant Examiner*—Matthew Luu
*Attorney, Agent, or Firm*—Antonelli, Terry, Stout & Kraus

[57] ABSTRACT

A photoconductive target having a transparent electrode layer and a photoconductive layer on a transparent substrate is disposed opposite to a group of integrated electron beam emitters having gate electrodes. A number of the electron emitters are activated to apply electron beams to the photoconductive target and the activated ones of the electron beam emitters are temporally changed over by an electron emitter selector circuit and a gate selector circuit. Signal charge generated and stored in the photoconductive layer is read. A time-series electric signal corresponding to a spatial distribution of the incident light is generated. A thin imaging apparatus suitable for a larger area is thus provided.

17 Claims, 13 Drawing Sheets

IMAGING APPARATUS AND OPERATION METHOD OF THE SAME

BACKGROUND OF THE INVENTION

The present invention relates to a thin imaging apparatus having large area for reading the distribution of signal charge quantity generated and stored in a photoconductive layer by incidence of photons and for generating an electric signal corresponding to the spatial distribution of the quantity of incident light, and relates to an operation method thereof.

A photoconductive image pickup tube is well known as an imaging apparatus which has a photoconductive layer for generating and storing signal charges according to the quantity of incident light and which reads out the signal charges generated and stored in the photoconductive layer into an external circuit in a time series form by using an electron beam and-generates an electric signal corresponding to the spatial distribution of the quantity of incident light. FIG. 5 is a schematic diagram showing the basic structure and operation principle of the photoconductive image pickup tube. An electron beam 502 emitted from a cathode electrode 501 is accelerated by a mesh electrode 503 to scan a photoconductive layer 504 under the control of electrostatic and/or electromagnetic deflection and focusing means (not illustrated). The electron beam scanning side, i.e., scanned surface, of the photoconductive layer 504 has a material and/or structure hard of emitting secondary electrons. When the scanning electron beam 502 arrives at the scanned surface, the potential of the scanned surface gradually falls. If the potential of the scanned surface becomes lower than that of the cathode electrode 501, however, the scanning electron beam cannot further arrive at the scanned surface. Immediately after it has been subjected to electron beam scanning, therefore, the potential of the scanned surface balances that of the cathode electrode 501. Target voltage $V_T$, which is positive with respect to the cathode potential, is applied to a transparent electrode 505. Therefore, an electric field so oriented as to be positive on the substrate side and negative on the scanned surface side is applied to the photoconductive layer 504. If incident light 506 is applied from the outside to the photoconductive layer 504 under this state, as many electron-hole pairs as determined by the quantity of incident light are generated in the photoconductive layer. The above described electric field makes electrons run to the substrate side and makes holes run to the scanned surface side. The potential of the scanned surface is gradually raised from the cathode potential by holes which have arrived at the scanned surface. When the scanning electron beam 502 arrives at the scanned surface subsequently, the potential of the scanned surface is reset to the cathode potential again. At that time, stored signal charge depending upon the quantity of incident light at a pertinent location flows through a load resistor 507. By means of electron beam scanning, therefore, time-series electric signal corresponding to the spatial distribution of the quantity of incident light is obtained from an output terminal 508. In FIG. 5, numeral 509 denotes a transparent substrate, and numeral 510 denotes an electron gun tube for vacuum seal. Operation principle of a photoconductive imaging tube is disclosed in JP-A-58-194231, for example.

As described above, a photoconductive imaging tube has a single electron emitter. In JP-A-55-25910, however, a plurality of electron emitters having negative electron affinities which can be controlled respectively independently are disclosed. By using this, a second conventional technique in which a target of a vidicon is scanned in a time division manner by a plurality of electron beams projected one after another, for example, has been disclosed.

However, the above described photoconductive imaging tube needs magnetic and/or electric deflecting and focusing means, such as a coil for deflecting and focusing an electron beam emitted from the single electron emitter and thereby scanning the photoconductive target, and a cylindrically patterned electrode. This results in a problem that the distance between the photoconductive target and the electron emitter is long and hence a thin imaging apparatus cannot be obtained.

Furthermore, in an apparatus using the above described second conventional technique, the quantity of emitted electrons is controlled by changing the potential of the electron emitter itself and it is impossible to make electrons arrive at the above described photoconductive target by emitting and/or accelerating electrons. As described in detail by referring to FIG. 5, the potential of the scanned surface in a photoconductive imaging tube immediately after electron beam scanning balances the potential of the cathode electrode. During a storage interval lasting until that place is subjected to electron beam scanning again, the potential is gradually raised by the signal charge generated by incident light. Typically, the value of this potential rise is approximately several volts. If an imaging tube, for example, has a size of ⅔ inch, a signal current of 200 nA, storage time of 1/60 sec, and a photoconductive layer made of amorphous Se having a thickness of 4 μm, then the potential of the scanned surface rises approximately 4 Volt during the storage interval. Since the potential rise of the scanned surface of the photoconductive target is thus small, it is extremely difficult to sufficiently extract electrons emitted from the cathode and make them arrive at the scanned surface. As a result of study made by the present inventors, such a configuration that a plurality of electron emitters are only disposed opposite to the photoconductive target as described above has been found to have the following problems. That is to say, it is difficult to make a sufficient amount of electron beams incident upon the scanned surface and control the quantity of incidence. Furthermore, since the electron beam emitted from the electron emitter is not sufficiently accelerated, the configuration is poor in property of going straight and beam bending is apt to cause resolution degradation and image distortion.

Furthermore, the present inventors have found that the apparatus using the above described second conventional technique has a problem that noise is caused by dispersion among the quantities of electrons emitted from electron emitters.

Furthermore, it has been found that the conventional photoconductive imaging tube and the apparatus using the above described second conventional technique has the following problems. That is to say, if it is attempted to obtain a thin imaging apparatus having a shortened distance between the photoconductive target and the electron emitter or an imaging apparatus, then the electrostatic capacity between the transparent electrode and the electron emitter and/or mesh electrode becomes large and hence degraded response increases the lag, resulting in one problem. If the quantity of incident light is large, then saturation of the output signal current due to insufficient quantity of electron beam causes a narrow dynamic range, resulting in another problem.

SUMMARY OF THE INVENTION

A first object of the present invention is to provide a thin imaging apparatus and an operation method thereof;

A second object of the present invention is to provide an imaging apparatus having a higher resolution and less image distortion, and an operation method thereof;

A third object of the present invention is to provide an imaging apparatus having reduced noise, and an operation method thereof; and A fourth object of the present invention is to provide an imaging apparatus having a reduced lag and an increased dynamic range, and an operation method thereof.

The above described first to third objects can be achieved by an imaging apparatus including a photoconductive target having at least an electrode transmitting incident light from outside and a photoconductive layer generating signal charge in response to incidence of the light, a plurality of electron beam emitters disposed opposite to the photoconductive target, means for temporally changing over electron beam emitters emitting electrons among the electron beam emitters, means for reading signal charge generated and stored in different places in the photoconductive layer, means for generating a time-series electric signal corresponding to a spatial distribution of the incident light, and gate electrodes for emitting electrons from the electron beam emitters and/or accelerating the electrons to make the electrons arrive at the photoconductive target.

Furthermore, the above described fourth object can be achieved in the above described imaging apparatus by causing electrons to be emitted from a plurality of electron beam emitters at each time point.

Furthermore, by forming the transparent electrode by using a plurality of electrically separated partial electrodes in the imaging apparatus, the first and third objects can be achieved more efficiently.

These and other objects and many of the attendant advantages of the invention will be readily appreciated as the same becomes better understood by reference to the following detailed description when considered in connection with the accompanying drawing.

DESCRIPTION OF THE PREFERRED EMBODIMENTS

Figure 3:
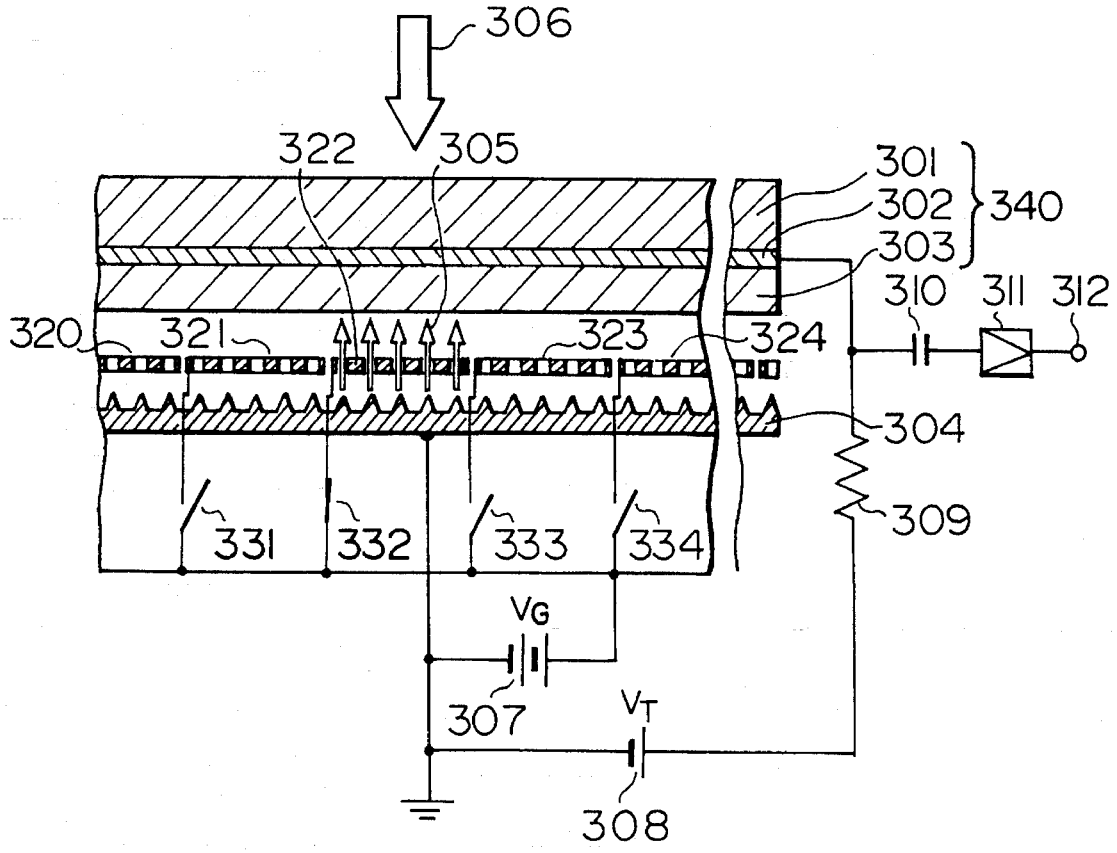
FIG. 3 is a sectional view showing the basic configuration of an imaging apparatus according to the present invention.

The basic configuration and operation principle of an imaging apparatus according to the present invention will now be described by referring to FIG. 3. Although the present invention can be applied to both one-dimensional imaging apparatuses and two-dimensional imaging apparatuses, FIG. 3 is a partial sectional view of a two-dimensional imaging apparatus and shows the basic configuration of the two-dimensional imaging apparatus. In FIG. 3, numeral 301 denotes a transparent substrate, 302 a transparent electrode, 303 a photoconductive layer, 304 an integrated electron emitter, 305 an electron beam, 306 incident light, 307 gate power supply, 308 target power supply, 309 a load resistor, 310 capacitance, 311 an amplifier, 312 an output terminal, 320 to 324 gate electrodes,-and 331 to 334 switches. A photoconductive target 340 is formed by the transparent substrate 301, the transparent electrode 302, and the photoconductive layer 303. In the same way as conventional photoconductive imaging tubes, the photoconductive layer 303 has such a structure as to block injection of holes from the transparent electrode 302 and injection of electrons from the scanned surface side which is scanned by the electron beam 305. In addition, the scanned surface side has such a structure that secondary electrons are hardly emitted in response to injection of the electron beam 305.

The electron beams 305 emitted from the electron emitters 304, disposed on the opposite side of vacuum space from the photoconductive target, are controlled by the gate electrodes 320 to 324. In the case of FIG. 3, the gate electrodes are divided into portions 320, 321, . . . 324 respectively for controlling a plurality of electron emitters. The gate electrodes 320 to 324 are connected to switches 330, 331, . . . 334 respectively corresponding to them. (The switch 330 is not illustrated.) When these switches are in on-states, the potential of corresponding gate electrodes is made equal to gate potential $V_G$ which is made higher than the potential of the electron emitters by the gate power supply 307. In FIG. 3, the switch 332 is in the on-state and a plurality of electron beams 305 emitted from a portion of the electron emitters 304 corresponding to the gate electrode 322 arrive at the photoconductive layer 303. In this way, the scanned surface of the photoconductive layer 303 is scanned by the electron beam 305 emitted from a predetermined electron emitter at each time. Since the scanned surface side of the photoconductive layer 303 hardly emits secondary electrons, the potential of the scanned surface 303 immediately after it has been subjected to scanning by the electron beam 305 balances the potential of the electron emitters (depicted to be the ground potential in FIG. 3). Since the potential of the transparent electrode 302 is made equal to the target potential $V_T$ which is higher than the potential of the electron emitters 304 by the potential of the target power supply 308, an electric field so oriented as to be positive on the substrate side and negative on the scanned surface side is applied to inside of the photoconductive layer 303. If in this state the incident light 306 from the outside is applied to the photoconductive layer 303 through the transparent substrate 301 and the transparent electrode 302, as many electron-hole pairs as determined by the quantity of incident light are generated in the photoconductive layer. The above described electric field makes electrons run to the substrate side and makes holes run to the scanned surface side. The potential of the scanned surface is gradually raised from the potential of the electron emitters. When the scanning electron beam 305 arrives at the scanned surface subsequently, the potential of the scanned surface is reset to the potential of the electron emitters again. At that time, stored signal charge depending upon the quantity of incident light at a pertinent location flows through a load resistor 309 via the transparent electrode 302. From the output terminal 312, a time-series electric signal corresponding to the spatial distribution of the quantity of incident light is obtained.

The imaging apparatus according to the present invention has an advantage in that the gate electrodes 320 to 324 facilitate control over electron beams emitted from the electron emitters 304 to arrive at the scanned surface. Furthermore, since the emitted electron beams are incident on the scanned surface after they have been accelerated by the gate electrodes, the electron beams emitted from respective electron emitters are incident on opposite scanned surface efficiently, and resolution degradation and image distortion due to beam bending are not caused.

Furthermore, in the imaging apparatus of the present invention, a plurality of electron beams are simultaneously applied to an area subjected to an electron beam at a certain time, i.e., to one pixel. Integrated electron emitters have a problem that quantities of electrons emitted from electron emitters are dispersed. By thus applying electron beams from a plurality of electron emitters simultaneously, however, they can be averaged and the quantity of electron beams can be made uniform from pixel to pixel. In case a photoconductive target basically identical with a photoconductive imaging tube is subjected to electron beam scanning to read signals as in the imaging apparatus of the present invention, electron beams equivalent in quantity to the quantity of charge stored by incident light make a landing on the scanned surface as described above and no more electron beams arrive at the scanned surface. In principle, therefore, a change in the quantity of the scanning electron beam is not reflected in the quantity of signal current. More strictly speaking, however, the balance value of the potential of the scanned surface after scanning is varied with the quantity of the scanning electron beam by the landing characteristic of the electron beam, as described in "Imaging Engineering", Corona Publishing Co. Ltd., pp. 92–95, for example. The present inventors made detailed experiments on this influence. As a result, it was found that in the imaging apparatus of the present invention dispersion of quantity of electron beam from pixel to pixel generated noise in the signal current by the above described effect. Therefore, this problem can be solved by simultaneously applying electron beams from a plurality of electron emitters to reduce fluctuation of the quantity of electron beam from pixel to pixel.

Furthermore, by making the gate electrodes 320, 321, 323 and 324 having switches which are in the off-state as shown in FIG. 3 float electrically from the gate electrode 322 having a switch which is in the on-state, the electron emitters 304, and the transparent electrode 302, it is possible to improve the response characteristic of the imaging apparatus and reduce the lag. If capacitance formed by the transparent electrode 302 and the gate electrodes is large, there occurs a problem that so-called capacitive lag caused by beam resistance of electron beam becomes large. By adopting the structure as described above, however, capacitance formed between the transparent electrode 302 and the gate electrodes which contributes to generation of lag is limited to capacitance formed by the gate electrode having a switch which is in the on-state. Therefore, lag can be significantly reduced as compared with, for example, the case where all gate electrodes are connected and an electron emitter for applying an electron beam is selected by switching potentials of the electron emitters. This effect is especially effective in case an imaging apparatus having a large area has been made and in case the distance between the gate electrodes and the scanned surface is short. If the potential of a gate electrode which is in the off-state is held to a high value in the same way as the on-state, gate electrodes which do not emit electrons function as so-called floating gates as if the switches are in the on-state. Thus, it is not desirable. Such a problem can be solved by bringing the gate electrodes once to, for example, a predetermined low potential, lower than the potential of the electron emitters before bringing the gate electrodes to the above described electrically floating state.

Figure 4:
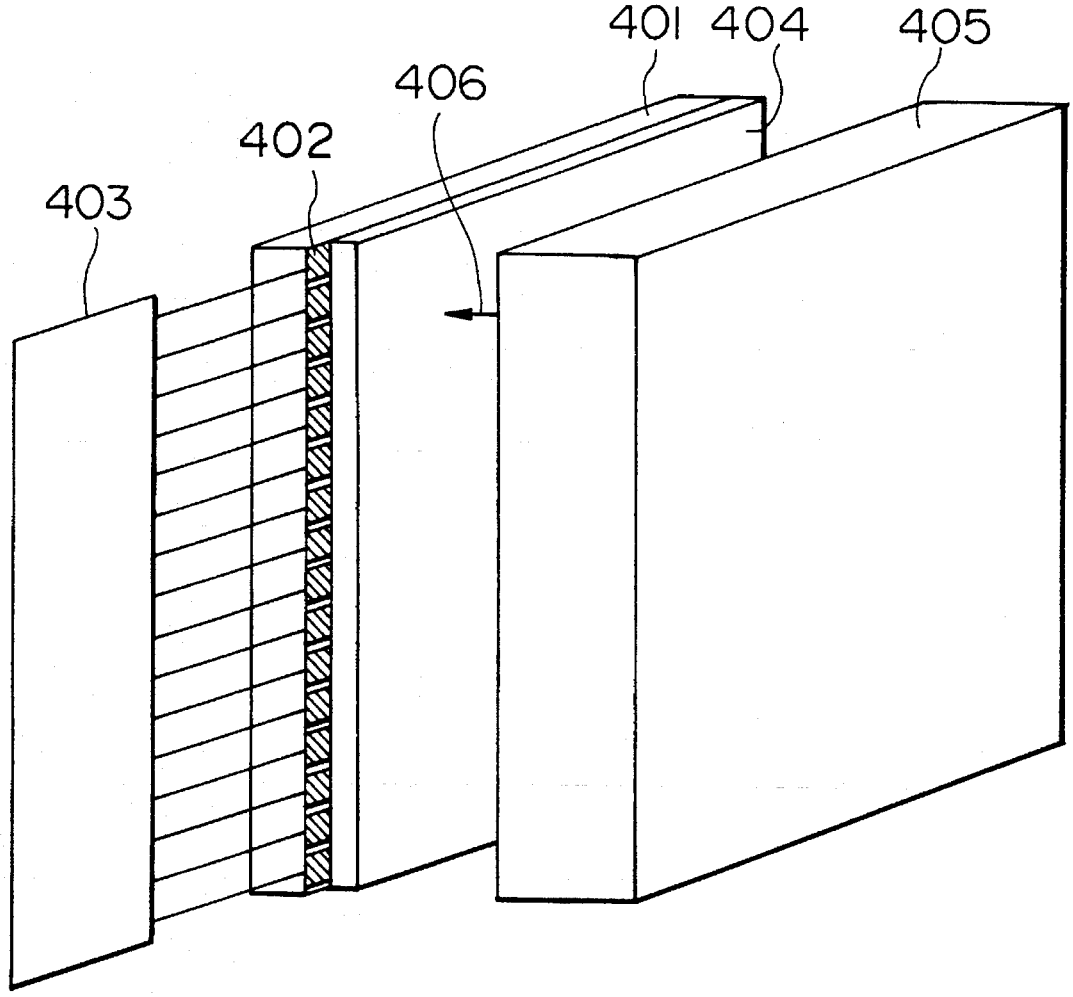
FIG. 4 is a diagram showing the basic configuration of an imaging apparatus according to the present invention.
Figure 5:
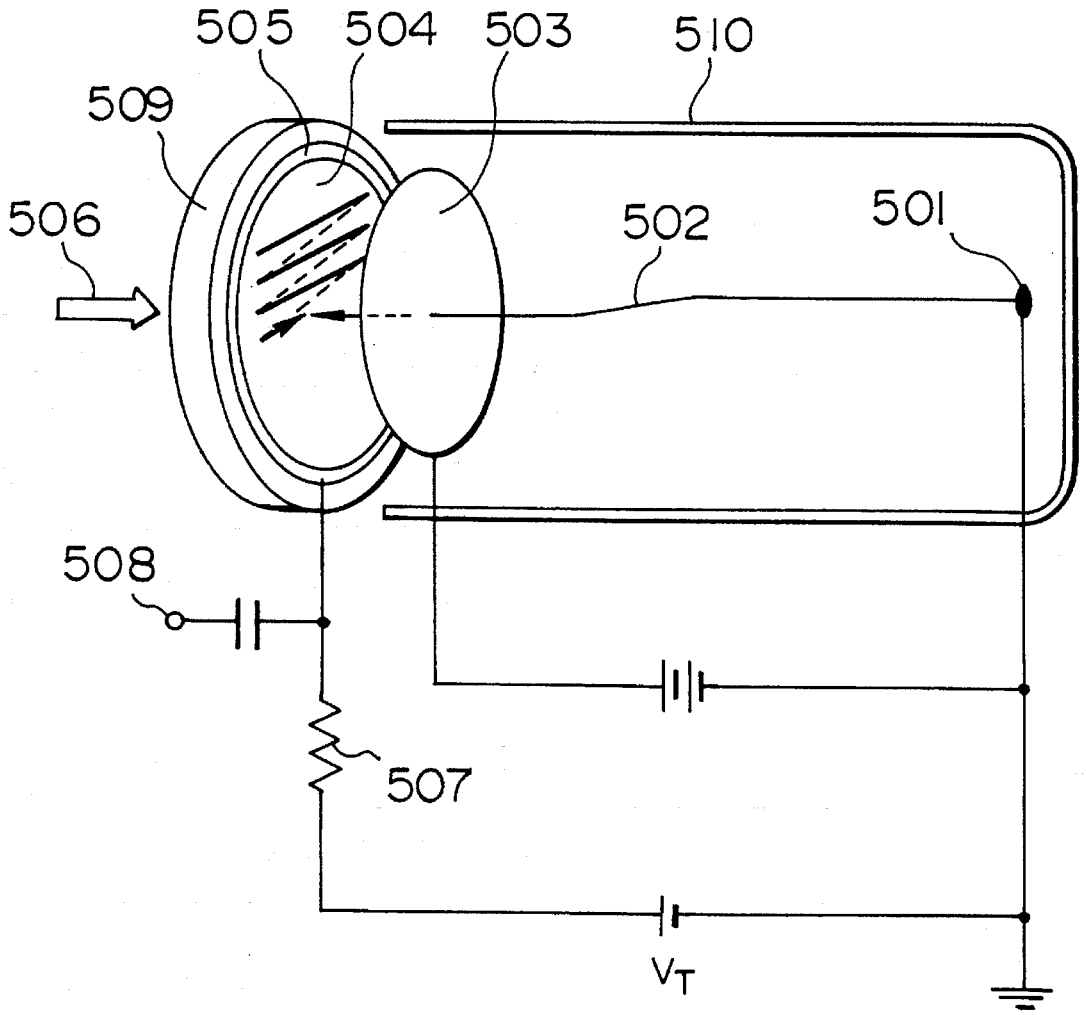
FIG. 5 (PRIOR ART)
FIG. 5 is a schematic diagram of a conventional photoconductive imaging tube.

Operation of the imaging apparatus according to the present invention will now be described further by referring to FIG. 4. In FIG. 4, numeral 401 denotes a transparent substrate, 402 a transparent electrode including a plurality of (16 in FIG. 4) stripe-shaped partial electrodes electrically separated, 403 an output circuit, 404 a photoconductive layer, 405 a scanning circuit having a plurality of electron beam emitters and an electron emitter selector circuit, and 406 an electron beam.

As described above, there is a problem that the response characteristic of the apparatus becomes worse and the lag is significant in case the electrostatic capacities formed by the gate electrodes, the electron beam emitters, and the transparent electrode are large. In the imaging apparatus of the present invention, the transparent electrode includes a plurality of electrically separated partial electrodes 402, and those partial electrodes are connected to the output circuit 403. In the output circuit 403, output currents from respective partial electrodes are amplified and processed to output a video signal corresponding to the spatial distribution of light incident on the entire apparatus. The electrostatic capacities relating to the response characteristic of signal readout from respective partial electrodes are irrelevant to the area of the entire apparatus, and are electrostatic capacities formed by each partial electrode, gate electrode, and electron beam emitter. Therefore, the lag is significantly reduced as compared with the case where the transparent electrode is an electrode having a large area extending over the entire apparatus.

Furthermore, by, for example, simultaneously scanning pixels corresponding to two or more adjacent partial electrodes with a plurality of electron beams and adding up signals read out by two or more beam scanning operations, the effective quantity of beam can be increased and hence the dynamic range can be expanded.

(Embodiment 1)

Figure 1:
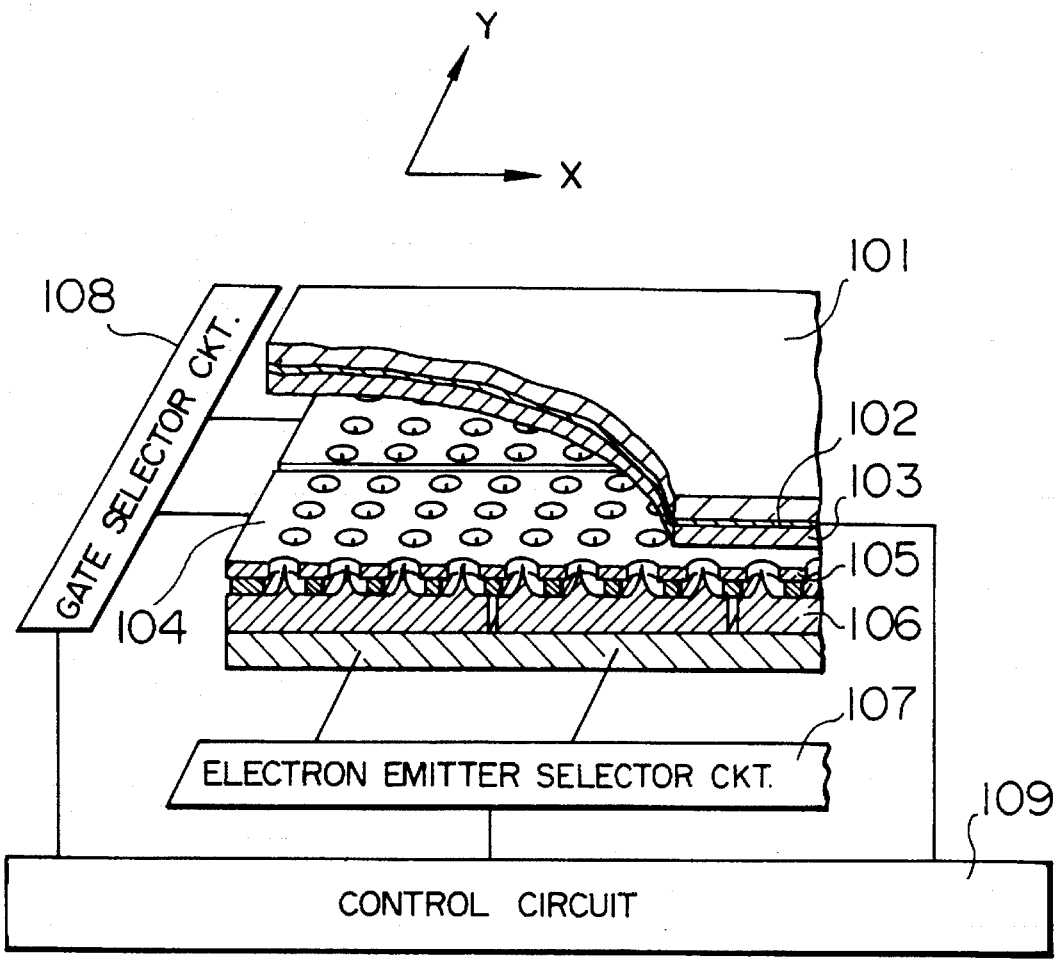
FIG. 1 is a configuration diagram of an imaging apparatus according to a first embodiment of the present invention.

FIG. 1 is a diagram showing the configuration of an imaging apparatus according to the present invention. For brevity, however, the number of electron emitters is omitted. As for the electron emitters 106, common electron emitters are formed of every four columns extending in the illustrated Y direction. As for the gate electrodes 104, common electrodes are formed of every four columns extending in the illustrated X direction. The X coordinate of the electron emitting position is determined by an electron emitter selector circuit 107, and the Y coordinate is determined by a gate selector circuit 108. From 16 electron emitters of the position wherein both the electron emitter and gate electrode have been selected, electron beams are applied to the scanned surface of a photoconductive layer 103. In accordance with predetermined synchronizing signals, a control circuit 109 controls the electron emitter selector circuit 107 and the gate selector circuit 108 to perform electron beam scanning. In addition, the control circuit 109 forms a video signal output from the output current of the transparent electrode 102. In FIG. 1, numeral 101 denotes a transparent substrate and numeral 102 denotes a transparent electrode. Numeral 105 denotes an insulation layer for insulating the gate electrodes 104 from the electrode emitters 106.

Figure 2:
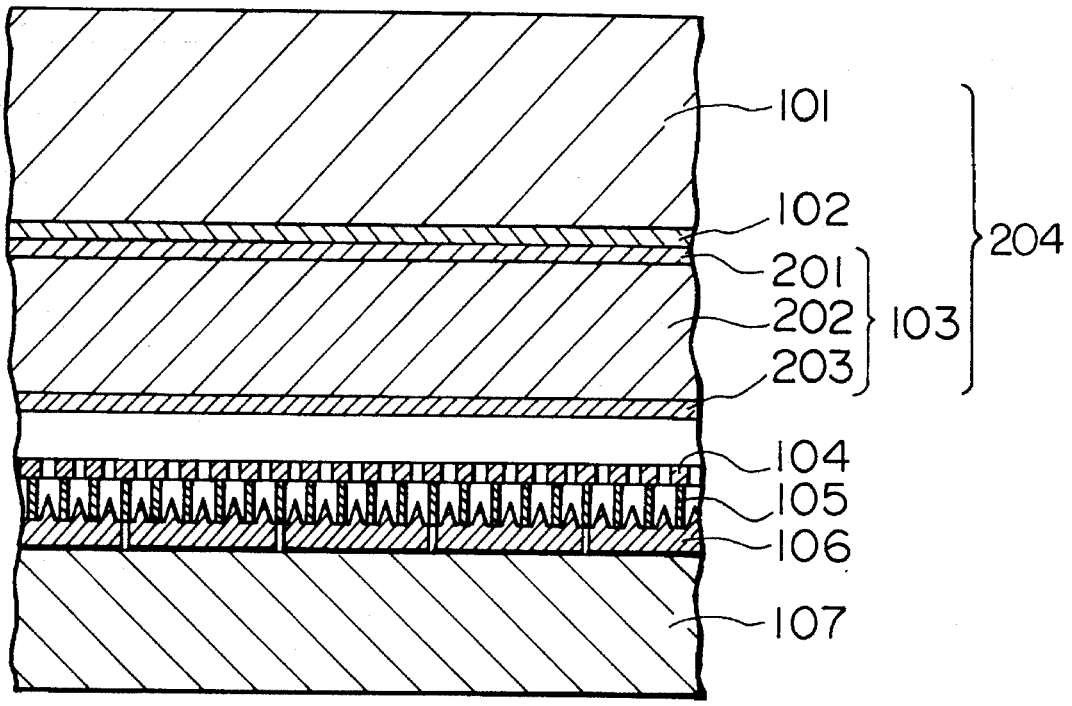
FIG. 2 is a sectional view of the imaging apparatus according to the first embodiment of the present invention.

FIG. 2 is a sectional view of the photoconductive target 204 and the electron emitter portion of the above described imaging apparatus. The structure and fabrication method of the imaging apparatus according to the present invention will now be described in more detail by referring to FIG. 2. On the smoothed and cleaned transparent glass substrate 101, the transparent electrode 102 having a thickness of 15 nm is formed by sputtering. The transparent electrode 102 contains tin and has indium oxide as the principal ingredient. As evaporation sources controlled separately, $CeO_2$, Se, $As_2Se_3$, and $Sb_2S_3$ are mounted on a rotational co-evaporation chamber having a turn table. The turn table rotates so that samples may pass over respective evaporation sources with independently controlled shutters. In this rotational co-evaporation chamber, $CeO_2$ having a thickness-of 10 nm is formed as a hole blocking layer 201 for blocking the injection of holes into a photoconductive layer 202. As the photoconductive layer 202, an amorphous semiconductor layer having a thickness of 4 μm is formed. The amorphous semiconductor layer has Se as the principal ingredient and contains one atomic percent of As. Furthermore, as both an electron blocking layer for blocking injection of electrons into the photoconductive layer and a beam landing layer, a porous $Sb_2S_3$ layer 203 is formed so as to have a thickness of 100 nm by evaporation in Ar gas atmosphere of 0.2 Torr, a photoconductive target being thus formed. The electron emitter selector circuit 107 is formed on a Si substrate by a process similar to that of a conventional integrated circuit. On that electron emitter selector circuit 107, an electron beam scanning portion is formed. The electron beam scanning portion includes field emitters 106 having conical Si electrodes, the insulation layer 105 made of $SiO_2$, and gate electrodes 104 made of Nb evaporation layers. The electron beam scanning portion was formed by using the photolithography technique or the anisotropic etching. The electron beam emitters were disposed at intervals of 4 μm. Subsequently, the above described photoconductive target and electron beam scanning portion were mounted to a vacuum envelope for holding them so as to make them opposite to each other. Then a vacuum seal was formed to obtain the imaging apparatus of the present embodiment. At this time, the space between the scanned surface and the gate electrode was decided to be approximately 100 μm. It is noted that a portion between the porous $Sb_2S_3$ layer 203 and the gate electrode 104 is formed of a vacuum.

In the imaging apparatus of the present embodiment, operation is conducted with the potential of the gate electrodes made 150 V higher than the potential of electron emitters at the time of beam emission. Furthermore, the potential of the transparent electrode is made 460 V higher than the potential of the electron emitters at the time of electron beam emission. The potential of the scanned surface after electron beam scanning balances the potential of electron emitters. Therefore, an electric field of approximately $1.15\times10^6$ V/cm is applied to the photoconductive layer having a layer thickness of 4 μm. In amorphous Se, avalanche multiplication of charge occurs in an electric field of approximately $8\times10^5$ V/cm or above. In case of the present embodiment, its multiplication factor becomes approximately ten.

In the imaging apparatus of the present embodiment, the position of electron emission can be arbitrarily selected by the electron emitter selector circuit and the gate electrode selector circuit. The imaging apparatus can be operated with a desired scanning method. At this time, gate electrodes and electron emitters which are not selected are electrically separated from the selected gate electrode and electron emitter. Therefore, the imaging apparatus of the present embodiment has a feature that the lag caused by electrostatic capacity formed by the transparent electrode 102, the gate electrode 104, and the electron emitter 106 is reduced. Amorphous Se used as the photoconductive layer in the present embodiment is a material which is high in dark resistance and excellent in photoconductivity. Especially, by applying the avalanche multiplication operation, the sensitivity can be made significantly high. In the present embodiment, As affixed to amorphous Se is a material for stabilizing the structure of amorphous Se and improving the heat resistance. The electron blocking layer 203 and the hole blocking layer 201 play an important role in reducing the dark current, improving the signal to noise ratio, and reducing the lag.

In FIG. 1, each pixel is shown to include 16 electron beam emitters for brevity. In the present embodiment, however, electron emitters were disposed at intervals of 4 μm and the pixel size was decided to be 100 μm square. Therefore, each pixel includes approximately 600 electron emitters. The dispersion in quantity of electron beam emitted from each electron emitter is leveled, and the quantity of beam per pixel is made uniform. It is necessary that the emitted electron beam does not spread out to such a degree that degradation of resolution poses a problem. However, it is desirable that the emitted electron beam spread to such a degree that electron beam shade (portion whereat no electron beams arrive) is not formed in the scanned area. Depending upon the interval of electron emitters, the size of pixels, the shape and voltage of gate electrodes, and the distance between the photoconductive target and electron emitters, an optimum state can be attained.

In the present embodiment, conical Si was used as the field emitters 106. However, a cathode material other than Si such as, for example, Mo, Ta, W, or TaC may be used. Its shape may also be a planar electron emitting plane. As compared with hot cathodes, cold cathodes such as field emitters have an advantage in being easily integrated. Although cold cathodes other than field emitters, such as those of tunnel-type, avalanche-type, or negative electron affinity-type may be used, use of electron emitters having a low electron temperature has especially an advantage of reduced lag.

(Embodiment 2)

Figure 6:
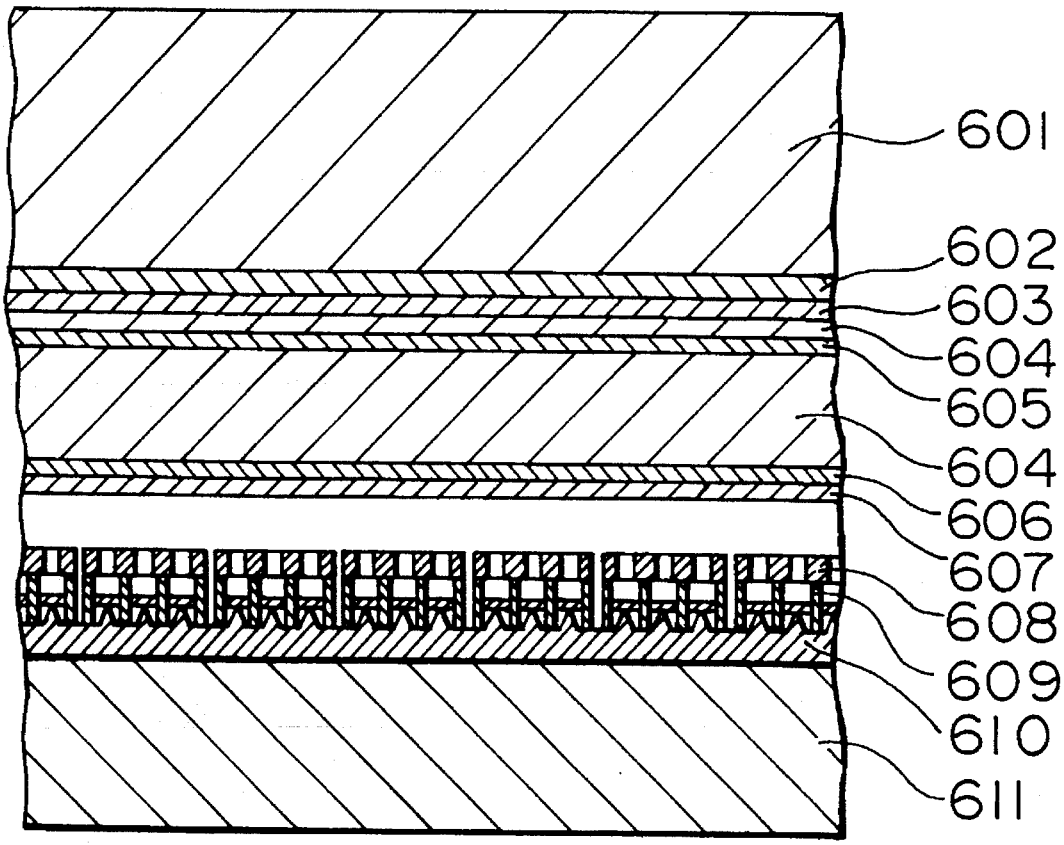
FIG. 6 is a sectional view of an imaging apparatus according to a second embodiment of the present invention.

A second embodiment of the present invention will now be described by referring to FIG. 6. On a transparent glass substrate 601, a transparent electrode 602 containing tin oxide as the principal ingredient and having a thickness of 20 nm is formed by using the CVD method. By then using a rotational co-evaporation chamber having $CeO_2$, Se, Te, $As_2Se_3$, and $Sb_2S_3$ as evaporation sources, $CeO_2$ having a thickness of 10 nm is formed as a hole blocking layer 603, and an amorphous semiconductor layer of a thickness of 6 μm having Se as the principle ingredient and containing one atomic percent of As is formed as a photoconductive layer 604. At this time, a layer 605 containing 30% Te is deposited in a part of the photoconductive layer. Finally, $Sb_2S_3$ is evaporated to have a thickness of 60 nm as an electron blocking layer 606. Thereafter, Ar gas of 0.25 Torr is introduced into the apparatus, and a beam landing layer 607 having porous $Sb_2S_3$ of 100 nm in thickness is deposited by evaporation to form a photoconductive target. The electron beam scanning portion includes planar W cold cathodes of field emission-type 610 arranged at intervals of 5 μm, an insulation layer 609 made of $SiO_2$, and gate electrodes 608 made of Mo evaporation layers. The above described photoconductive target and electron beam scanning portion are mounted to a vacuum envelope for holding them so as to make them opposite to each other. Then, a vacuum seal is formed to obtain the imaging apparatus of the present embodiment.

In the present embodiment, the potential of the electron emitters 610 is common to pixels. Selection of electron emitters is made by using gate electrodes separated for respective pixels. One pixel corresponds to a plurality of electron emitters. In FIG. 6, numeral 611 denotes a scanning circuit substrate. This has a function of selectively applying voltage of 200 V with respect to electron emitters to gate electrodes 608. At this time, gate electrodes which are not selected are electrically separated from the selected gate electrode and electron emitter as described before by referring to FIG. 3. Therefore, the electrostatic capacity formed by the transparent electrode 602 and the gate electrodes 608 is always kept to minimum, resulting in an imaging apparatus having reduced lag. The amorphous Se layer 605 containing Te has an advantage in raising sensitivity to red light. By combining the imaging apparatus of the present embodiment with a suitable color filter, a color imaging apparatus excellent in color reproducibility is obtained.

(Embodiment 3)

Figure 7:
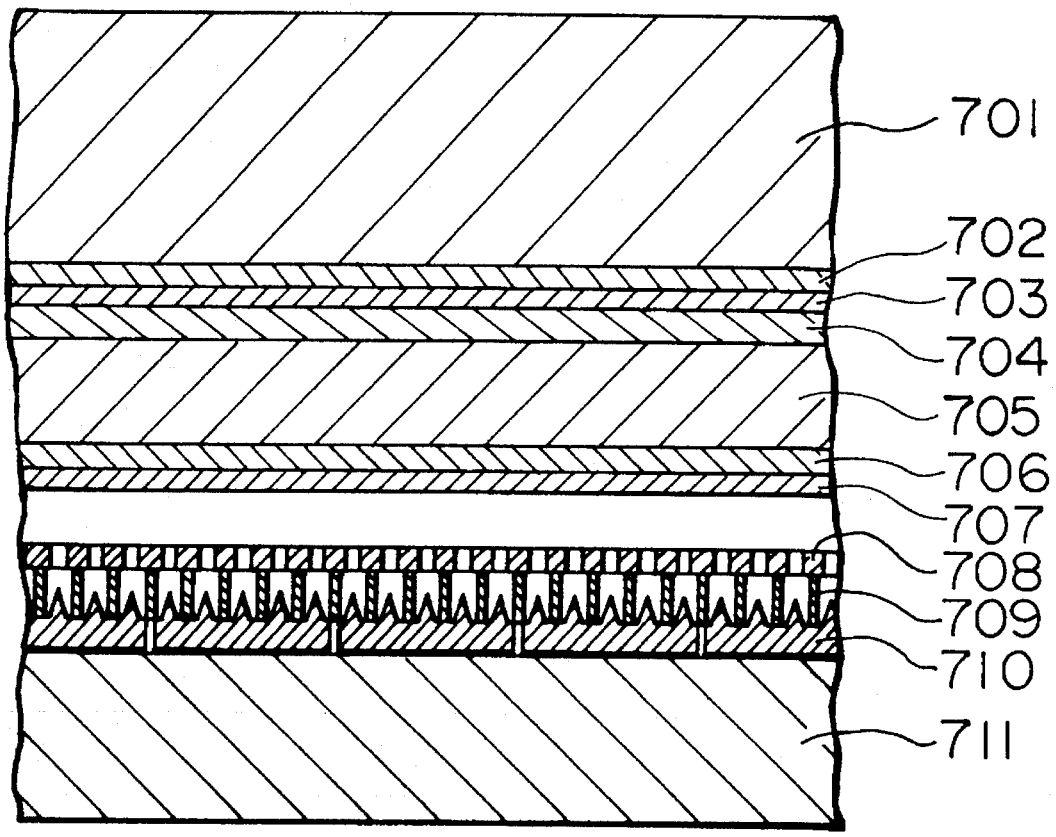
FIG. 7 is a sectional view of an imaging apparatus according to a third embodiment of the present invention.

A third embodiment of an imaging apparatus according to the present invention will now be described by referring to FIG. 7. In the present embodiment, an imaging apparatus of the present embodiment has been applied to a linear image sensor. FIG. 7 shows a part of sectional view in its lengthwise direction. On a transparent glass substrate 701, a transparent electrode 702 is deposited by evaporation in oxygen atmosphere by using In containing 10% Sn as evaporation sources. Thereafter, $SiO_2$ having a thickness of 15 nm is formed as a hole blocking layer 703. Subsequently, by high-frequency plasma decomposition of mixture gas including $SiH_4$ and $PH_3$ diluted with $H_2$, $SiH_4$, and mixture gas including $SiH_4$ and $B_2H_6$ diluted with $H_2$, and n-type hydrogenated amorphous Si (a-Si:H) layer 704 having a thickness of 30 nm, i-type a-Si:H layer 705 having a thickness of 2 μm, and a p-type a-Si:H layer 706 having a thickness of 50 nm are deposited one after another. Finally as both electron blocking layer and beam landing layer 707, porous $Sb_2S_3$ is deposited by evaporation in $N_2$ gas atmosphere of 0.2 Torr to have a thickness of 150 nm, a photoconductive target being thus formed. The electron beam scanning portion is formed in the same way as the first embodiment. In the present embodiment, however, the gate electrode 708 is a common electrode. Selection of the electron emitter which should emit electrons is conducted by successively providing an electron emitter 710 with a potential which is negative with respect to the gate electrode by using a scanning circuit 711. The electron emitter is divided to pixels, and each pixel has a plurality of cathodes. Each pixel has a shape of 50 nm square arranged at intervals of 5 μm. One pixel has approximately 100 electron emitters. For brevity, five electron emitters are shown in FIG. 7 to be included in one pixel width of the lengthwise direction.

The a-Si:H used as the photoconductive layer in the present embodiment has an advantage over, for example, amorphous Se in being excellent in heat resistance and high in sensitivity to red light. Furthermore, in case electron beam scanning is performed by changing over the electron emitter potential as in the present embodiment, a feature of simple structure is obtained because the gate electrode is common.

(Embodiment 4)

Figure 8:
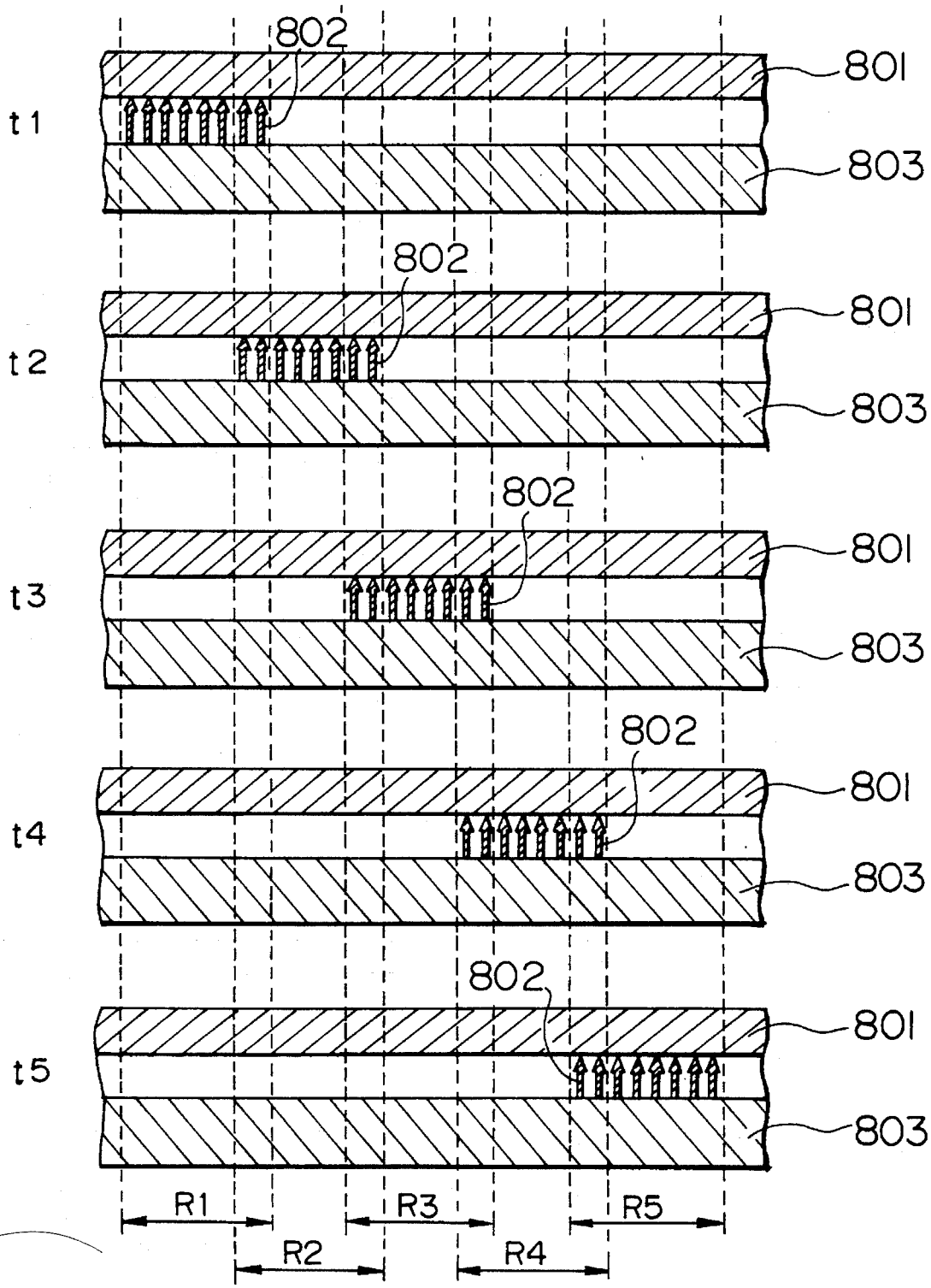
FIG. 8 is a diagram illustrating the scanning method of an imaging apparatus according to a fourth embodiment of the present invention.

A scanning method of imaging apparatus according to the present invention will now be described by referring to FIG. 8. An imaging apparatus of the present embodiment was formed in the same way as the first embodiment. FIG. 8 shows the change of emission position of scanning electron beam during consecutive time points $t_1$ to $t_5$. Numeral 801 denotes a photoconductive target. Numeral 802 denotes an electron beam. Numeral 803 denotes a scanning circuit having a plurality of electron beam emitters and an electron emitter selector circuit. The present embodiment is so configured that in changing over an electron emitter selector circuit from an electron beam emission state at a certain time point to a state at a succeeding time point, a part of electron emitters may be selected in common in those two states. FIG. 8 shows how scanning is performed while emitting electrons simultaneously from eight electron emitters. As illustrated, two common electron emitters emit electron beams in two temporally adjacent states. Electron beam radiation ranges $R_1$ to $R_5$ at time points $t_1$ to $t_5$ partially overlap with radiation ranges at adjacent time points. Such operation can be attained, for example, in the second embodiment by performing electron beam scanning while simultaneously selecting a plurality of separated gate electrodes and by selecting a part of gate electrodes in common at adjacent time points.

According to the present embodiment, boundaries between pixels do not exist distinctly. Operation is conducted like an imaging tube for deflecting a single electron beam and performing scanning consecutively. Thereby, it is possible to prevent occurrence of moire fringes and reduce noise of a high-frequency region while maintaining marginal resolution.

(Embodiment 5)

Figure 9:
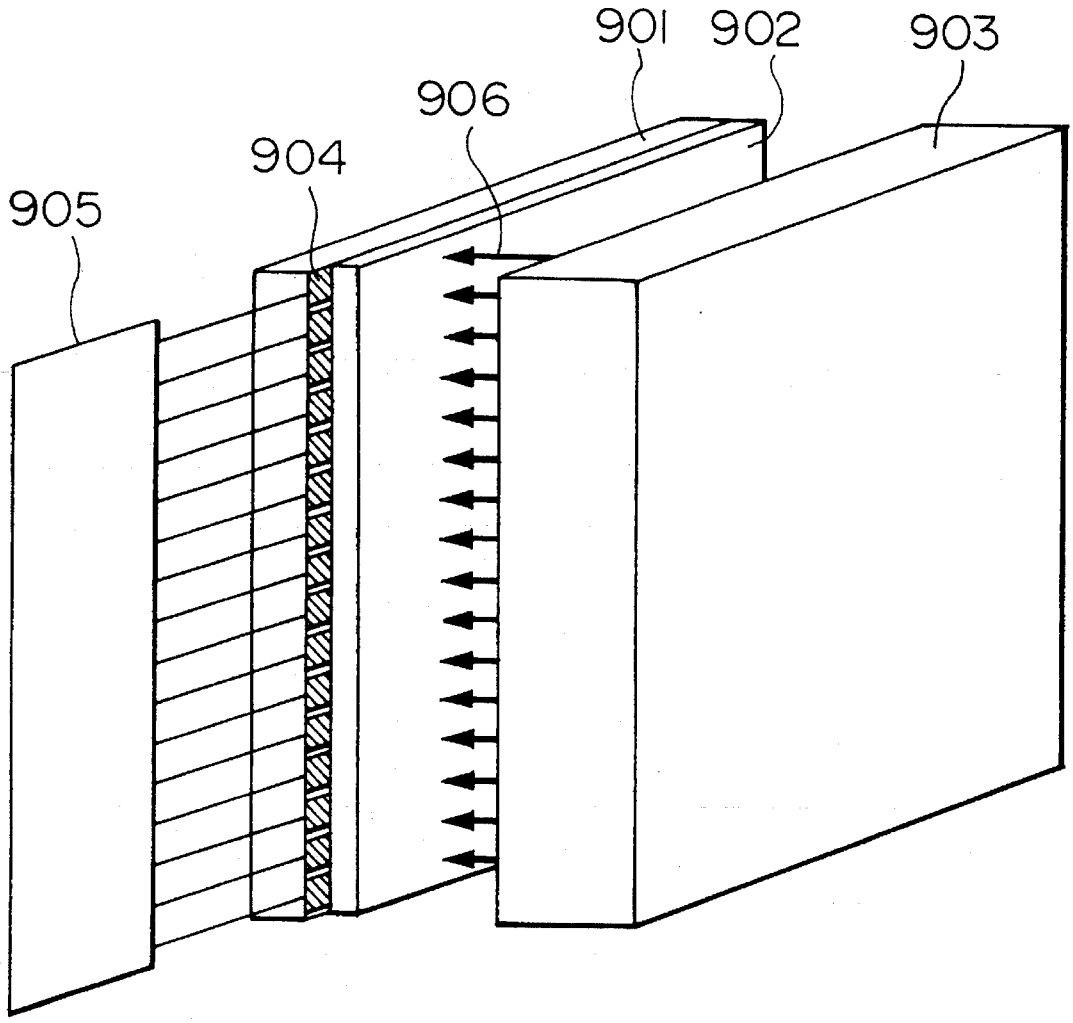
FIG. 9 is a basic configuration diagram of an imaging apparatus according to a fifth embodiment of the present invention.

A fifth embodiment of an imaging apparatus according to the present invention will now be described by referring to FIG. 9. In FIG. 9, a transparent substrate 901, a photoconductive layer 902, and an electron beam emitter and scanning circuit 903 are similar to, for example, those of the embodiment 1, and hence description of them will be omitted. In the present embodiment, a transparent electrode 904 has a plurality of electrically separated stripe-shaped partial electrodes and respective partial electrodes are connected to an output circuit 905. Furthermore, in the present embodiment, scanning is performed in a direction parallel to the stripe-shaped partial electrodes while a plurality of electron beams 906 are being applied simultaneously to the photoconductive layer 902 on respective partial electrodes. Signal currents outputted simultaneously from respective partial electrodes are amplified and processed by the output circuit 905. A video signal is outputted as a time-series electric signal corresponding to the spatial distribution of light incident on the entire apparatus.

In the present embodiment, lag is reduced because the transparent electrode has a plurality of electrically separated partial electrodes. In addition, it is possible to increase the scanning speed and reduce the bandwidth by simultaneously reading output signals from respective partial electrodes in parallel. Therefore, the imaging apparatus of the present embodiment is suitable for imaging apparatuses each having a large area. For example, a contact-type two-dimensional image sensor having an effective imaging area equivalent to A4 size can also be obtained.

(Embodiment 6)

Figure 10:
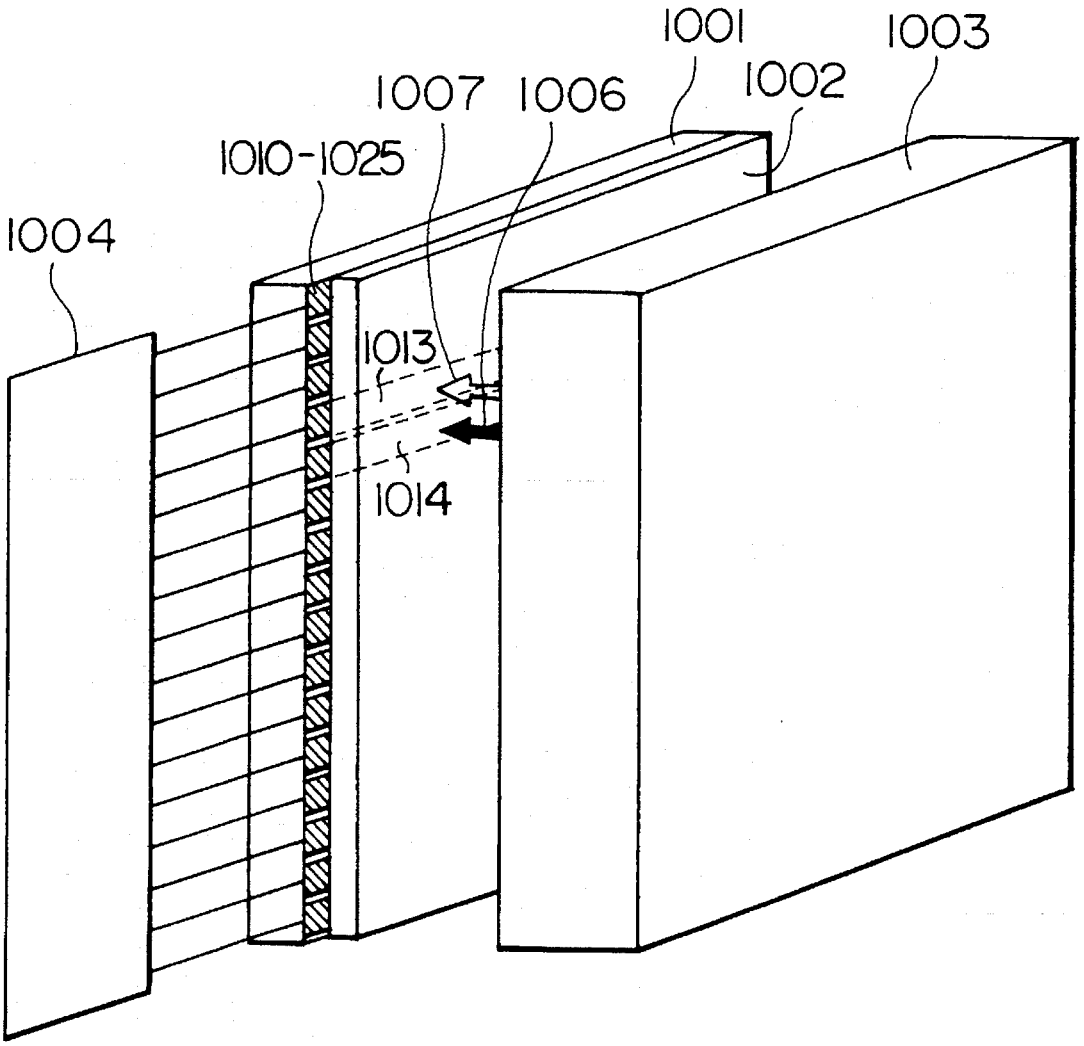
FIG. 10 is a basic configuration diagram of an imaging apparatus according to sixth and seventh embodiments of the present invention.

A sixth embodiment of an imaging apparatus according to the present invention will now be described by referring to FIG. 10. In the present embodiment, a transparent substrate 1001, a photoconductive layer 1002, and electrically separated transparent electrodes 1010 to 1025 are similar to those of the above described fifth embodiment, and hence description of them will be omitted. From an electron beam emitter and scanning circuit 1003, electron beams 1006 and 1007 are simultaneously applied to the scanned surface on two adjacent transparent electrodes. The electron beam 1006 reads out the stored signal charge into an output circuit 1004 via a transparent electrode 1014, a video signal being thus formed. On the other hand, the electron beam 1007 further scans the scanned surface which has already been scanned by the electron beam 1006. However, a signal current read out thereby via a transparent electrode 1013 does not contribute to the video signal in the output circuit.

In case some stored signal charge is left behind due to a change of balance potential of the scanned surface caused by an abrupt change of the quantity of incident light, for example, or some stored signal charge is left behind due to excessive incident light and limit on electron beam quantity, the residual charge can be simultaneously erased in the imaging apparatus of the present embodiment while normally continuing readout scanning. Therefore, the imaging apparatus of the present embodiment has an advantage in that lag and so-called comet tail phenomenon are restrained. The lag erase electron beam 1007 need not necessarily be radiated all the times, but may also be radiated in response to an abrupt change of the quantity of incident light and excessive incident light. Furthermore, also in case there are no stripe-shaped separate electrodes unlike the present embodiment, the lag erase beam can be applied. In that case, it is necessary that a current read out at the time of radiation of the lag erase beam does not exercise a bad influence upon a signal current read out by an ordinary scanning electron beam.

(Embodiment 7)

A seventh embodiment different from the above described sixth embodiment will now be described by also referring to FIG. 10. Although the imaging apparatus of the present embodiment conducts multi-beam scanning in the same way as the embodiment 6, operation of the output circuit 1004 is different from that of the embodiment 6. That is to say, in embodiment 7, a signal current read out from, for example, stripe-shaped transparent electrode 1013 by the electron beam 1007 is added to a signal current read out when the same position on the transparent electrode 1013 is scanned by the electron beam 1006, a video signal being thus formed.

In case it is necessary to read out a signal current exceeding the limit of electron beam quantity unlike the above described sixth embodiment when some stored signal charge has been left behind due to excessive incident light and limit on electron beam quantity, the imaging apparatus of the present embodiment is effective. That is to say, at the time of such high illuminance that readout cannot be performed by conducting electron beam scanning once, the entire input signal can be read out by conducting scanning a plurality of times. Therefore, an imaging apparatus having a wide dynamic range is obtained. By the way, two or more electron beams may be used for duplicate readout.

(Embodiment 8)

Figure 11:
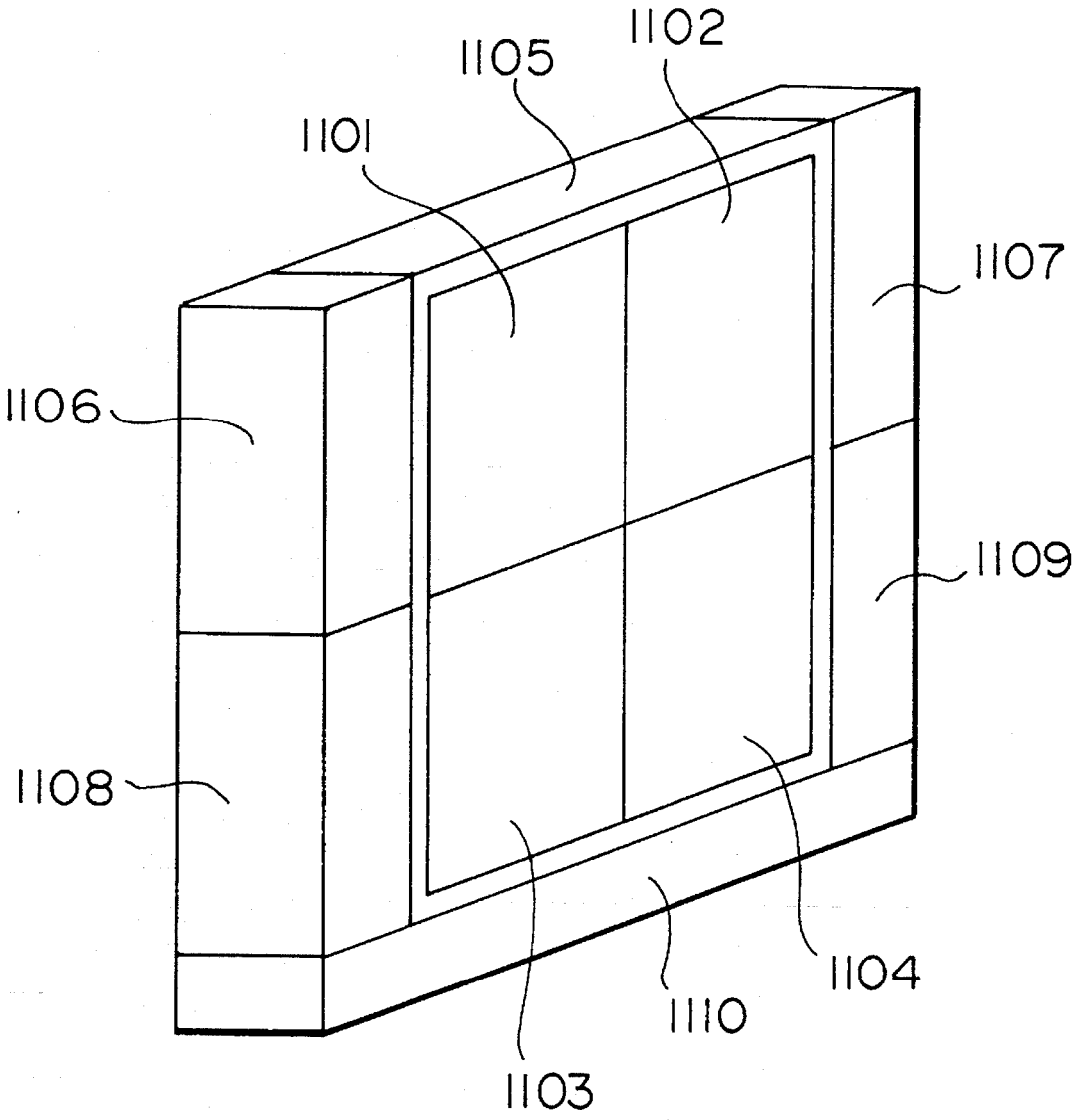
FIG. 11 is a configuration diagram of an imaging apparatus according to an eighth embodiment of the present invention.

An eighth embodiment of an imaging apparatus according to the present invention will now be described by referring to FIG. 11. In FIG. 11, numerals 1101 to 1104 denote imaging apparatuses similar to those of the embodiments described above and description of them will be omitted. In the present embodiment, four imaging apparatuses 1101 to 1104 are combined and held in a vacuum envelope 1105. Signals read out from output circuits 1106 to 1109 are processed in a signal processing circuit 1110. A video signal of light inputted to the above described four imaging apparatuses 1101 to 1104 as a whole is thus formed.

In the imaging apparatus of the present embodiment, imaging of a larger area is possible as compared with the case where the imaging apparatus according to the present invention is used singly. In case an imaging apparatus having a large area is formed by combining a plurality of imaging apparatuses according to the present invention as in the present embodiment, it is desirable to transmit incident light into a junction portion to an effective area of picture by using a lens or optical fiber, for example, and/or perform pixel interpolation by using image processing, as occasion demands so that a lack or abnormality of the video signal may not be caused at the junction.

(Embodiment 9)

Figure 12:
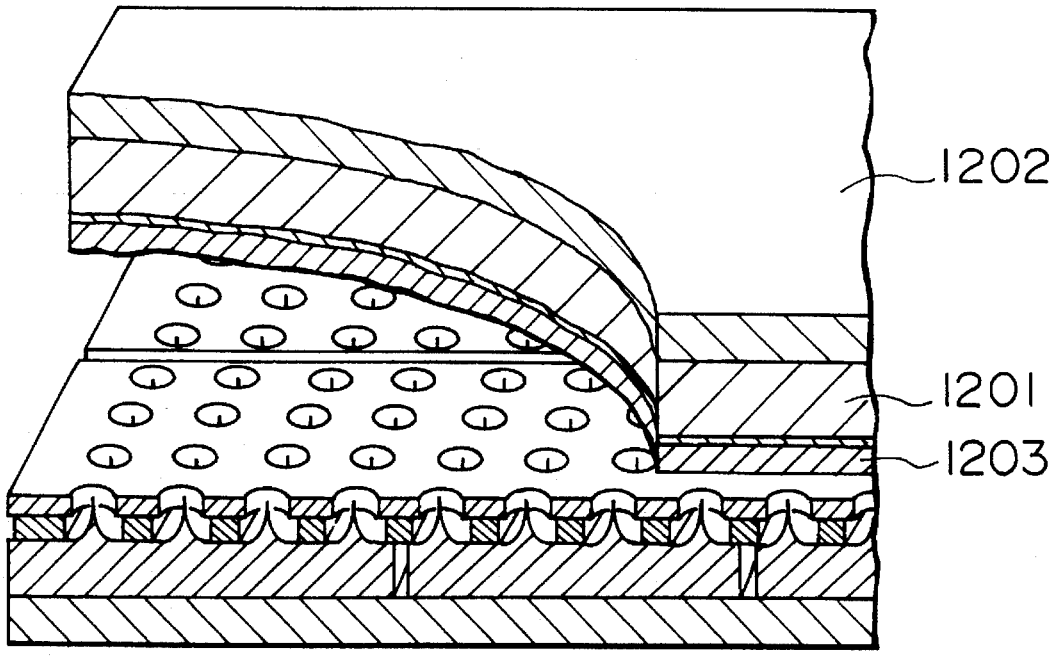
FIG. 12 is a configuration diagram of an imaging apparatus according to a ninth embodiment of the present invention.

A ninth embodiment of an imaging apparatus according to the present invention will now be described by referring to FIG. 12. In an imaging apparatus similar to the above described first to ninth embodiments, the present embodiment has, on the light incidence side of a transparent substrate 1201, a fluorescent layer 1202 emitting light in response to incidence of radiation. According to the present embodiment, there is obtained an imaging apparatus having a sensitivity for such radiation that a photoconductive layer 1203 does not have a sufficient sensitivity therefor.

(Embodiment 10)

Figure 13:
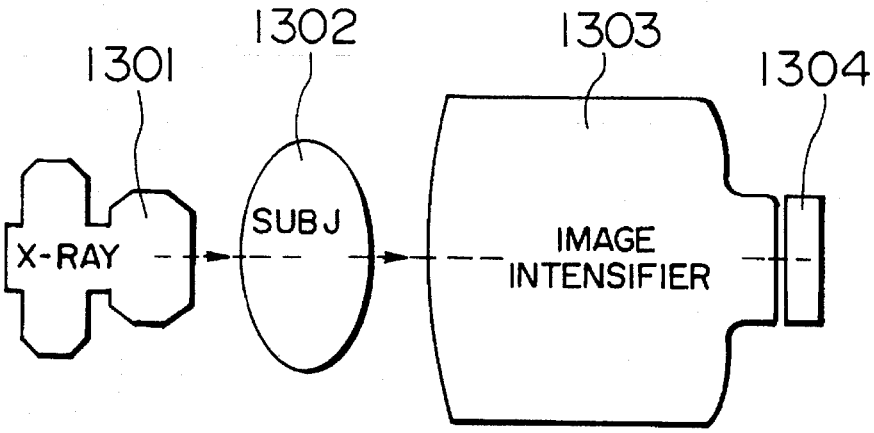
FIG. 13 is a configuration diagram of an imaging apparatus according to a tenth embodiment of the present invention.

A tenth embodiment of an imaging apparatus according to the present invention will now be described by referring to FIG. 13. The present embodiment is an X-ray imaging apparatus obtained by combining an imaging apparatus 1304 according to the present invention with an X-ray image intensifier 1303. An X-ray image emitted from an X-ray source 1301 and transmitted through a subject 1302 is inputted to the X-ray image intensifier 1303. In the X-ray image intensifier, light emitted from an input fluorescent screen by inputted X-rays is incident upon a photocathode, and emitted electrons are accelerated and focused to make an output fluorescent screen luminous. A resultant luminous image is detected by an imaging apparatus 1304 according to the present invention. A video signal corresponding to an X-ray image transmitted through the subject 1302 is thus obtained.

In the X-ray imaging apparatus of the present embodiment, the optical system between the X-ray image intensifier and the imaging apparatus can be shortened by using an imaging apparatus of the present invention increased in area as compared with, for example, conventional imaging tubes and solid state imaging apparatuses. Therefore, the X-ray imaging apparatus of the present embodiment has advantages in that the apparatus can be reduced in size, and the sensitivity drop caused by loss of the optical system is reduced. Especially if an imaging apparatus according to the present invention having an effective image area nearly equal to or larger than that of the output fluorescent screen of the X-ray image intensifier as shown in FIG. 13 is used, the above described optical system can be removed, being of great advantage.

(Embodiment 11)

Figure 14:
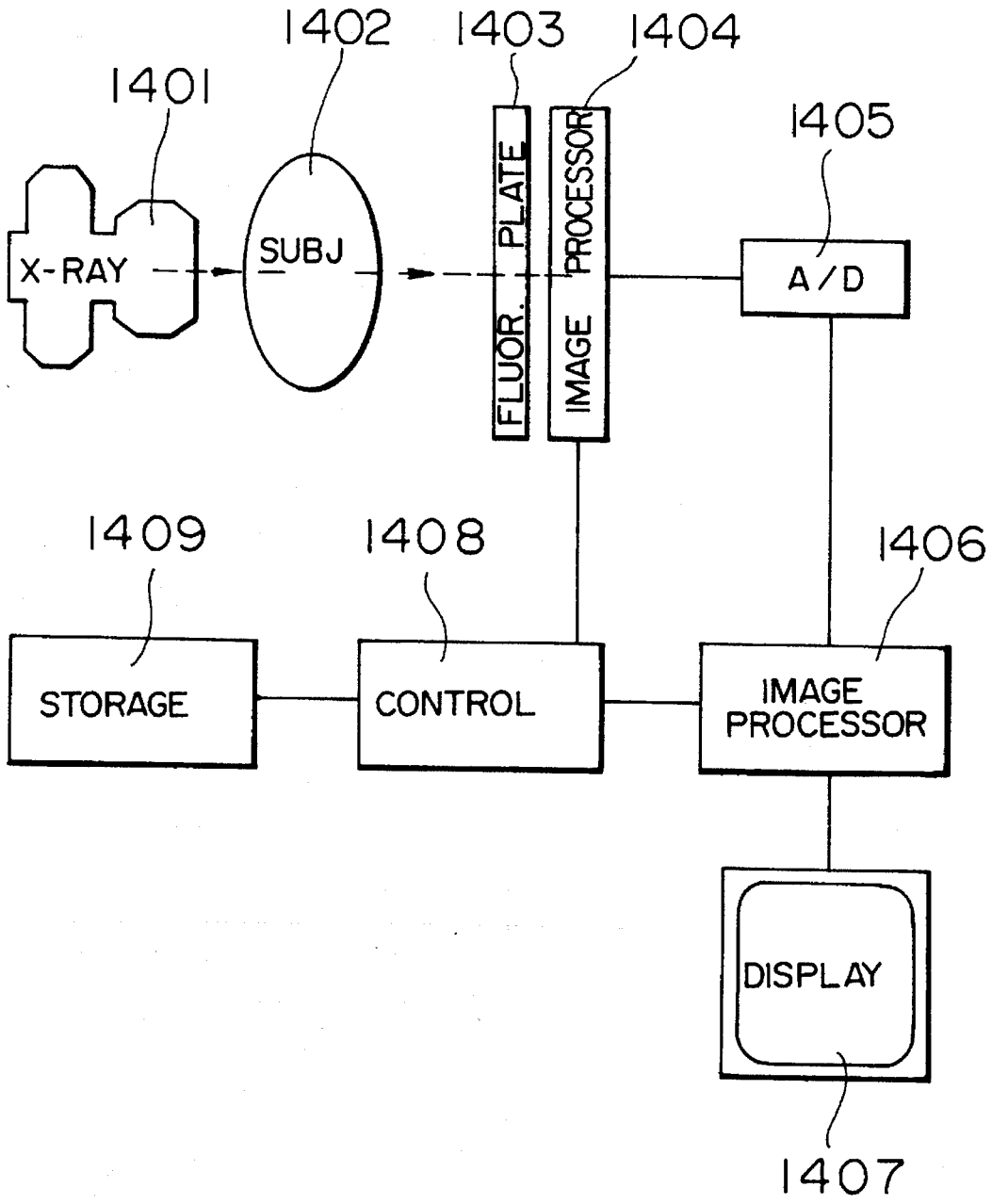
FIG. 14 is a configuration diagram of an imaging apparatus according to an eleventh embodiment of the present invention.

By referring to FIG. 14, an X-ray digital radiography system which is an eleventh embodiment of an imaging apparatus according to the present invention will now be described. An X-ray image emitted from an X-ray source 1401 and transmitted through a subject 1402 makes a fluorescent plate 1403 luminous. The resultant luminous image is detected by an imaging apparatus 1404 according to the present invention having a large area nearly equivalent to that of the fluorescent plate. The detected video signal is converted to a digital signal by an A/D converter 1405, and then subjected to processing in an image processor 1406 as occasion demands and displayed as an image by a display apparatus 1407. A control apparatus 1408 controls the imaging apparatus 1404 and the image processor 1406. In addition, the control apparatus 1408 preserves the digitized video signal in a storage apparatus 1409. The imaging apparatus 1404 was decided to have an effective image area of 40 cm square, a thickness of 5 cm, a pixel size of 100 μm square, and an electron emitter pitch of 5 μm. Therefore, one pixel has approximately 400 electron emitters, and the resolution corresponds to 4000 lines. In the X-ray digital radiography system of the present embodiment, an X-ray image intensifier is not needed because the imaging apparatus has a large area. Therefore, the X-ray digital radiography system of the present embodiment has advantages of small-size, high sensitivity, and high resolution.

As for the embodiments heretofore described, the case where the photoconductive target has a sensitivity to visible light has been mainly described. However, the imaging apparatus of the present invention is suitable also for the case where images of radiation other than visible light, such as infrared rays, ultraviolet rays, or X-rays, are directly detected by using a photoconductive layer sensitive to them. In that case, it is a matter of course that a constituent material depending upon radiation to be detected is desired to be selected. For example, Be or BN is used as the substrate, and PbO or amorphous Se having a layer thickness of at least 10 μm is used as the photoconductive layer to obtain an X-ray imaging apparatus.

As heretofore described in detail, the present invention provides a thin imaging apparatus having a large area and having advantages of high sensitivity, high resolution, low noise, low lag, and wide dynamic range.

It is further understood by those skilled in the art that the foregoing description covers preferred embodiments of the disclosed apparatus and that various changes and modifications may be made in the invention without departing from the spirit and scope thereof.

We claim:

1. An imaging apparatus comprising:

a photoconductive target including a transparent electrode layer for transmitting incident light from outside and a photoconductive layer for generating and storing a signal charge in response to the incident light;

a plurality of electron beam emitters disposed adjacent said photoconductive layer of said photoconductive target, each electron beam emitter capable of assuming alternatively an activated state, in which the electron beam emitter emits electrons, and an inactivated state;

control means for temporarily changing over the state of said electron beam emitters to change the emitters which are emitting electrons from among said electron beam emitters;

means for reading a signal charge stored in a portion of said photoconductive layer; and gate electrodes for accelerating the emitted electrons from the activated electron beam emitters to transfer the electrons to said photoconductive target.

2. An imaging apparatus according to claim 1, wherein said control means includes means for successively changing over the potential of said gate electrodes to control the electron beam emitters transferring electrons at each time point.

3. An imaging apparatus comprising:

a photoconductive target including a transparent electrode layer for transmitting incident light from outside and a photoconductive layer for generating and storing a signal charge in response to the incident light;

a plurality of electron beam emitters disposed adjacent said photoconductive layer of said photoconductive target, each electron beam emitter capable of assuming alternatively an activated state, in which the electron beam emitter emits electrons, and an inactivated state;

control means for temporarily changing over the state of said electron beam emitters to change the emitters which are emitting electrons from among said electron beam emitters such that at any point in time at least a first one with a second one of said electron beam emitters are emitting electrons and at an immediately subsequent point in time at least the second one and a third one of said electron beam emitters are emitting electrons;

means for reading a signal charge stored in a portion of said photoconductive layer; and means for reading out signal charge of one pixel by using a plurality of electron beam emitters.

4. An imaging apparatus comprising:

a photoconductive target including a transparent electrode layer for transmitting incident light from outside and a photoconductive layer for generating and storing a signal charge in response to the incident light;

a plurality of electron beam emitters disposed adjacent said photoconductive layer of said photoconductive target, each electron beam emitter capable of assuming alternatively an activated state, in which the electron beam emitter emits electrons, and an inactivated state;

control means for temporarily changing over the state of said electron beam emitters to change the emitters which are emitting electrons from among said electron beam emitters; and means for reading signal charge stored in a portion of said photoconductive layer;

wherein said transparent electrode layer comprises a plurality of electrically separated partial electrodes.

5. An imaging apparatus according to claim 4, wherein said control means causes a lesser plurality of said plurality of electron beam emitters to assume the activated states so that an area of the photoconductive target corresponding to a plurality of said partial electrodes is radiated by electron beams, and wherein said reading means reads out in parallel signal charge values stored in respective portions of said photoconductive layer.

6. An imaging apparatus according to claim 4, wherein said read means includes means for applying a first electron beam to first area of said photoconductive target to read signal charge stored therein, and for applying a second electron beam to a second area of said photoconductive target.

7. An imaging apparatus according to claim 4, wherein said reading means includes means for reading out signal charge stored on at least a part of said photoconductive target by conducting electron beam scanning a plurality of times, and means for combining the read out signals, thereby to form a video signal.

8. An imaging apparatus according to claim 1, wherein said photoconductive layer comprises an amorphous semiconductive layer.

9. An imaging apparatus according to claim 8, wherein said amorphous semiconductive layer has Se as a principal ingredient.

10. An imaging apparatus according to claim 8, wherein said amorphous semiconductive layer contains hydrogen and has Si as a principal ingredient.

11. An imaging apparatus according to claim 1, wherein said photoconductive layer includes means for multiplying the signal charge generated in response to the incident light.

12. An imaging apparatus comprising:

a plurality of imaging devices; and means for combining outputs of said imaging devices to output a resultant video signal, each of said imaging devices including:

a photoconductive target including a transparent electrode layer for transmitting incident light from outside and a photoconductive layer for generating and storing a signal charge in response to the incident light;

a plurality of electron beam emitters disposed adjacent said photoconductive layer of said photoconductive target, each electron beam emitter capable of assuming alternatively an activated state, in which the electron beam emitter emits electrons, and an inactivated state;

control means for temporarily changing over the state of said electron beam emitters to change the emitters which are emitting electrons from among said electron beam emitters;

means for reading signal charge stored in a portion of said photoconductive layer; and gate electrodes for accelerating the emitted electrons from the activated electron beam emitters to transfer the electrons to said photoconductive target, said gate electrodes being disposed between said photoconductive target and said plurality of electron beam emitters.

13. An imaging apparatus according to claim 1, wherein said photoconductive target further includes a fluorescent layer disposed on the light incident side thereof to absorb at least a part of the incident light, thereby generating signal charge in said photoconductive layer.

14. An imaging apparatus according to claim 13, wherein said incident light is generated by an output fluorescent screen of an X-ray image intensifier.

15. An imaging apparatus according to claim 13, wherein said incident light is generated by incidence of incident X-rays from outside upon a fluorescent plate.

16. An imaging apparatus according to claim 13, further comprising, means for converting the read out signal charge to a video signal, and means for digitizing the video signal.

17. An imaging method, utilizing an imaging apparatus including a photoconductive target having a transparent electrode layer for transmitting incident light from outside and a photoconductive layer for generating and storing signal charge in response to the incident light, and a plurality of electron beam emitters disposed adjacent said photoconductive layer of said photoconductive target, each electron beam emitter capable of assuming alternatively, an activated state, in which the electron beam emitter emits electrons, and an inactivated state, said method comprising the steps of:

(a) temporally changing over the state of said electron beam emitters to change the emitters which are emitting electrons from among said electron beam emitters; and (b) reading signal charge stored in a portion of said photoconductive layer;

wherein step (a) includes emitting electrons from a plurality of electron beam emitters at each time point.

* * * * *